US006292978B1

(12) United States Patent
Lakoduk et al.

(10) Patent No.: US 6,292,978 B1
(45) Date of Patent: Sep. 25, 2001

(54) DOOR STOP APPARATUS

(75) Inventors: Harold D. Lakoduk, Anoka; David Brouillard, Monticello, both of MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 0 days.

(21) Appl. No.: 09/231,417

(22) Filed: Jan. 14, 1999

(51) Int. Cl.[7] ..... E05C 17/16

(52) U.S. Cl. ..... 16/82; 16/366; 292/268; 292/269; 217/60 C

(58) Field of Search ..... 220/290; 190/34; 16/82, 371, 86 C, 366; 49/394; 292/269, 268, 270; 217/60 B, 60 C, 60 D, 60 R

(56) References Cited

U.S. PATENT DOCUMENTS

| | | | | |
|---|---|---|---|---|
| 906,514 | * | 12/1908 | Dengler | 292/268 |
| 1,532,239 | * | 4/1925 | Fauser | 16/82 |
| 1,737,397 | | 11/1929 | Williamson . | |
| 1,743,379 | | 1/1930 | Newren . | |
| 1,986,307 | * | 1/1935 | Wagner | 217/60 C |
| 2,587,200 | * | 2/1952 | Nottingham | 217/60 C |
| 2,842,278 | * | 7/1958 | Murphy | 292/269 |
| 3,986,742 | * | 10/1976 | Heaney et al. | 292/268 |

FOREIGN PATENT DOCUMENTS

| | | |
|---|---|---|
| 345 447 | 12/1921 | (DE) . |
| 0 398 196 A2 | 5/1990 | (EP) . |

OTHER PUBLICATIONS

Product Catalog, *Hoffman Engineering Company*, pp. 31, 497, 529, 540 (1995).
Product Catalog, "Rittal Handbook 27", *Rittal*, p. 192 (1996).
Product Blueprints, *EMKA Beschlagteile GmbH & Co. KG*, pp. 6A–220, 6A–230 (Aug. 1996).
Product Catalog, *Hoffman Engineering Company*, pp. 9.05, 1.109 (1997).
Product Catalog, *Hoffman Enclosures Inc.*, p. 48 (1998).

* cited by examiner

*Primary Examiner*—Anthony Knight
*Assistant Examiner*—Mark Williams
(74) *Attorney, Agent, or Firm*—Merchant & Gould P.C.

(57) ABSTRACT

A door stop apparatus holds a door in an open position. The door stop includes a first member mounting to the door and having a slot formed therein with a ramp portion located at one end of the slot. A link member pivotally mounts to a bracket on a door frame. A follower mounts to an end of the link and slides along the slot in the guide member. The follower slides up and over the ramp when slid along the slot in a first direction and engages an abrupt edge of the ramp when slid in the opposite direction.

15 Claims, 8 Drawing Sheets

DOOR STOP APPARATUS

BACKGROUND

1. Field of the Invention

The present invention is directed to an enclosure with a door stop and in particular, to a door stop apparatus providing a positive mechanical stop to hold the door in an open position.

2. Prior Art

Enclosures used in outdoor applications often require a positive mechanical stop for holding the door open. If the door is not balanced or if it is outside and subject to wind, the door may swing shut unless it is held open. The interior of the enclosure should be easily accessible for maintenance, repair or other work that requires the door to be positively held open for extended periods of time. This allows the worker to access the interior without having to hold the door, allowing the worker greater flexibility and improved safety and efficiency.

Simple door stops are often just a wedge placed between the door and the floor. Devices for maintaining enclosure doors, such as doors for electrical enclosures, in an open position typically have utilized a shoulder bolt on a moving arm that drops into a widened area in a channel. Although these devices do keep the door open, this configuration requires careful alignment so that the shoulder bolt drops into the widened hole without hanging up. Often, it may take some jiggling of the door to attain the proper alignment for the bolt to drop through or the door many not stay open. Over time, dirt and grime may build up to make alignment and free movement more difficult. A further problem with such designs is the single orientation to which the device is limited. Left hand and right hand opening doors, or mounting at the top and bottom typically require different embodiments to accommodate the various door configurations. This requires additional parts and raises manufacturing, assembly and stocking costs.

It can be seen that a new and improved door stop device is required to maintain a door in an open position. Such a door should provide a reliable, simple positive mechanical stop to maintain the door in the open position. Such a door should be easily alignable and should accommodate a device mounting in either a left or right opening orientation or be mounted near either the top or the bottom of the door. The present invention addresses these as well as other problems associated with enclosures and door stops.

SUMMARY

The present invention is directed to a door stop device for providing a positive mechanical retainer to hold a door in an open position.

The door stop includes a mounting bracket typically mounted to the frame providing a pivot point for a link member. The link member includes a follower that mounts to a slot in a guide member, typically mounted to the door. The follower slides along the slot as the door is opened and closed, causing the fixed distance of the link relative to the pivot point, to move along the slot.

The guide member includes a gate along the slot that provides for sliding the follower over the gate in a first direction, but engaging and being held by the gate in the opposite direction. The gate of the guide member includes flared portions ramped up from the face of the guide member on either side of the slot. The flared portions form a ramp that allows the follower and link to slide over the ramp in a first direction. However, the gate has an abrupt intersection with the horizontal surface on either side of the slot. Therefore, the follower and link may slide over the gradual intersection of the gate when moving in a first direction, and then gravity causes the element to fall downward and slide down the abrupt edge. However, when the travel direction is reversed, the follower and link abut the edge of the gate and are held in position. With this configuration, the door is held open when the abrupt edge retains the link member. To close the door, the follower and link are easily lifted and moved beyond the abrupt edge of the gate.

In one embodiment, the guide member includes a gate at each end of the slot extending out from opposite faces of the guide member. With this configuration, the guide member is reversibly and invertably mountable so that when the entire stop assembly is attached, it can be inverted for mounting along either the upper or lower portions of the door. The guide member also includes mounting holes on either side so that the relative direction of the member may be changed for use with either left or right opening doors. The mounting bracket may also be inverted for use in either the upper or lower edge. When inverted, the link will engage the upper surface of the gate rather than the follower, but the stop functions in an identical manner. In a second embodiment, the guide member includes a gate at a first end of the slot and a widened orifice at the opposite end allowing the follower to be inserted for easier assembly and disassembly.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT

Figure 1:
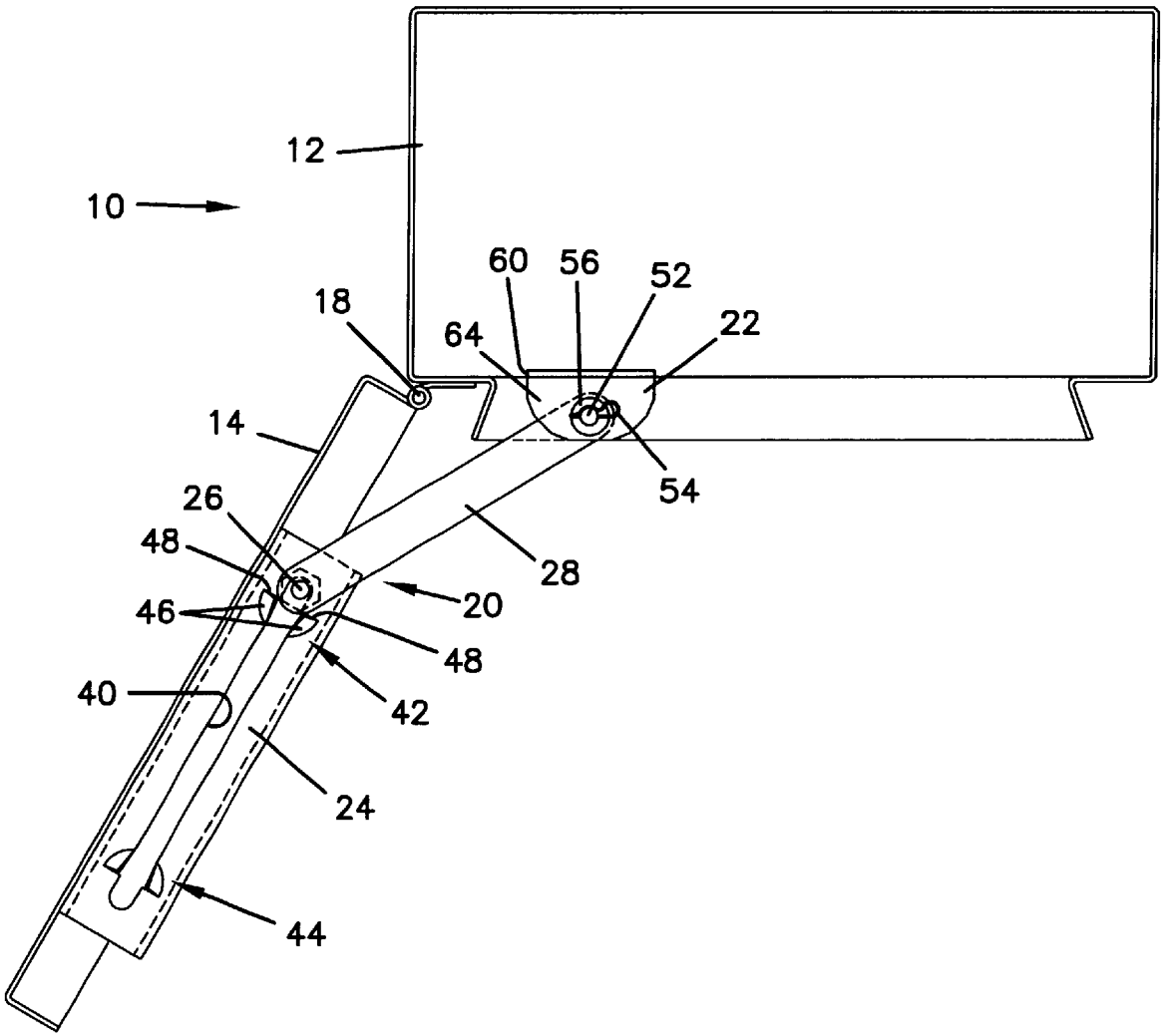
FIG. 1 shows a top plan view of a door stop apparatus mounted to an enclosure in an open position according to the principles of the present invention.
Figure 2:
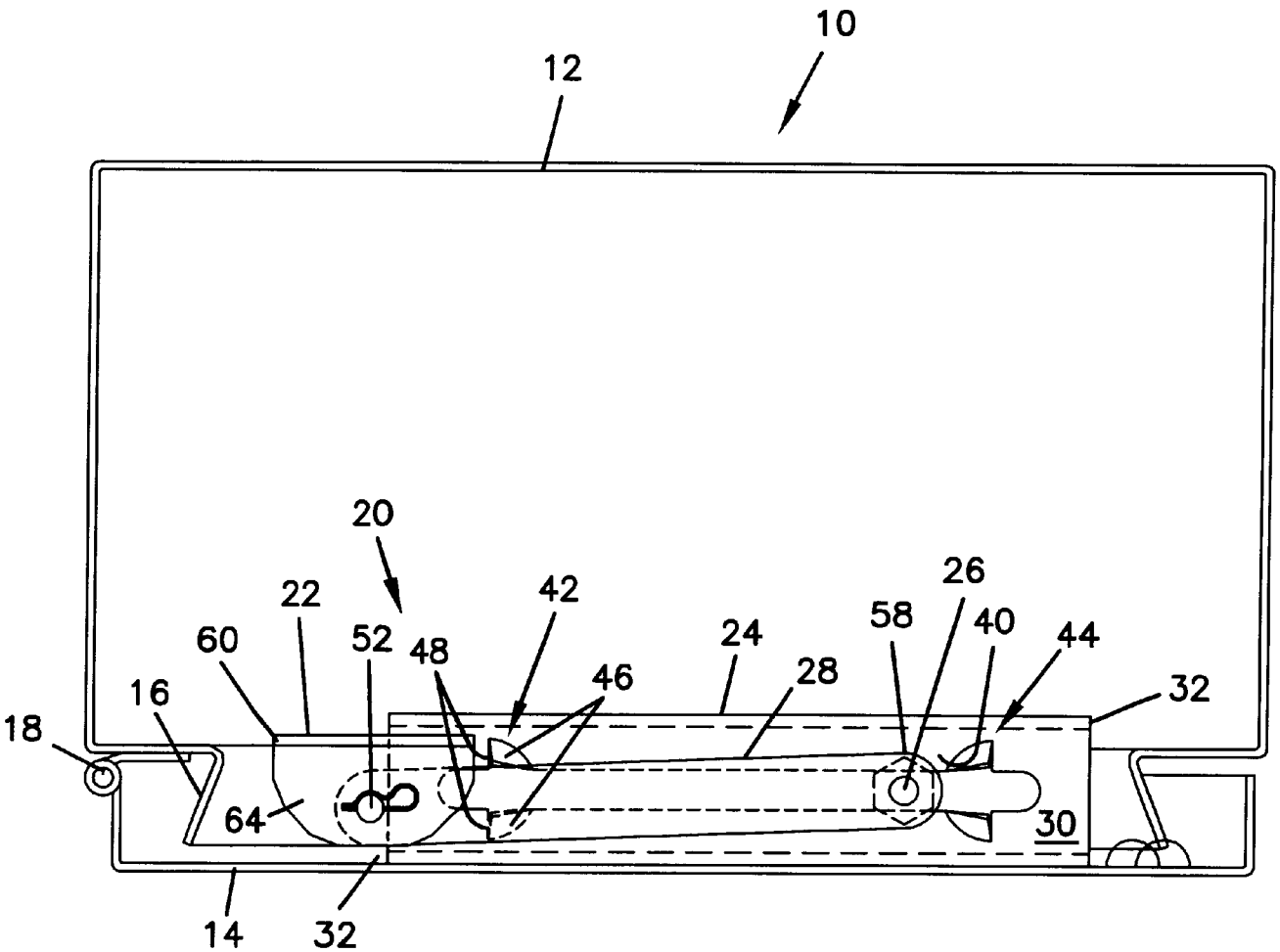
FIG. 2 shows a top plan view of the door stop apparatus of FIG. 1 in a closed position.

Referring now to FIGS. 1 and 2, there is shown an enclosure, generally designated 10 having a housing 12 with a door 14 mounted thereto. The door 14 mounts to a collar portion 16 of the housing 12 along one side on a hinge 18. The enclosure 10 includes a door stop, generally designated 20 according to the principles of the present invention. The door stop 20 has a mounting bracket 22 attached to the collar portion 16 of the enclosure 10 while a guide member 24 mounts to the interior side of the door 14 and moves with the door 14. The door stop 20 may also be configured with the guide member 24 mounted to the housing 12 and the bracket 22 mounted to the door 14. A link 28 pivotally connects to the mounting bracket 22 and to a follower 26 slidably mounted in a slot 40 of the guide member 24. The link 28 pivots between the open position shown in FIG. 1 and the closed position shown in FIG. 2, while the follower 26 slides longitudinally along the slot 40.

Figure 3:
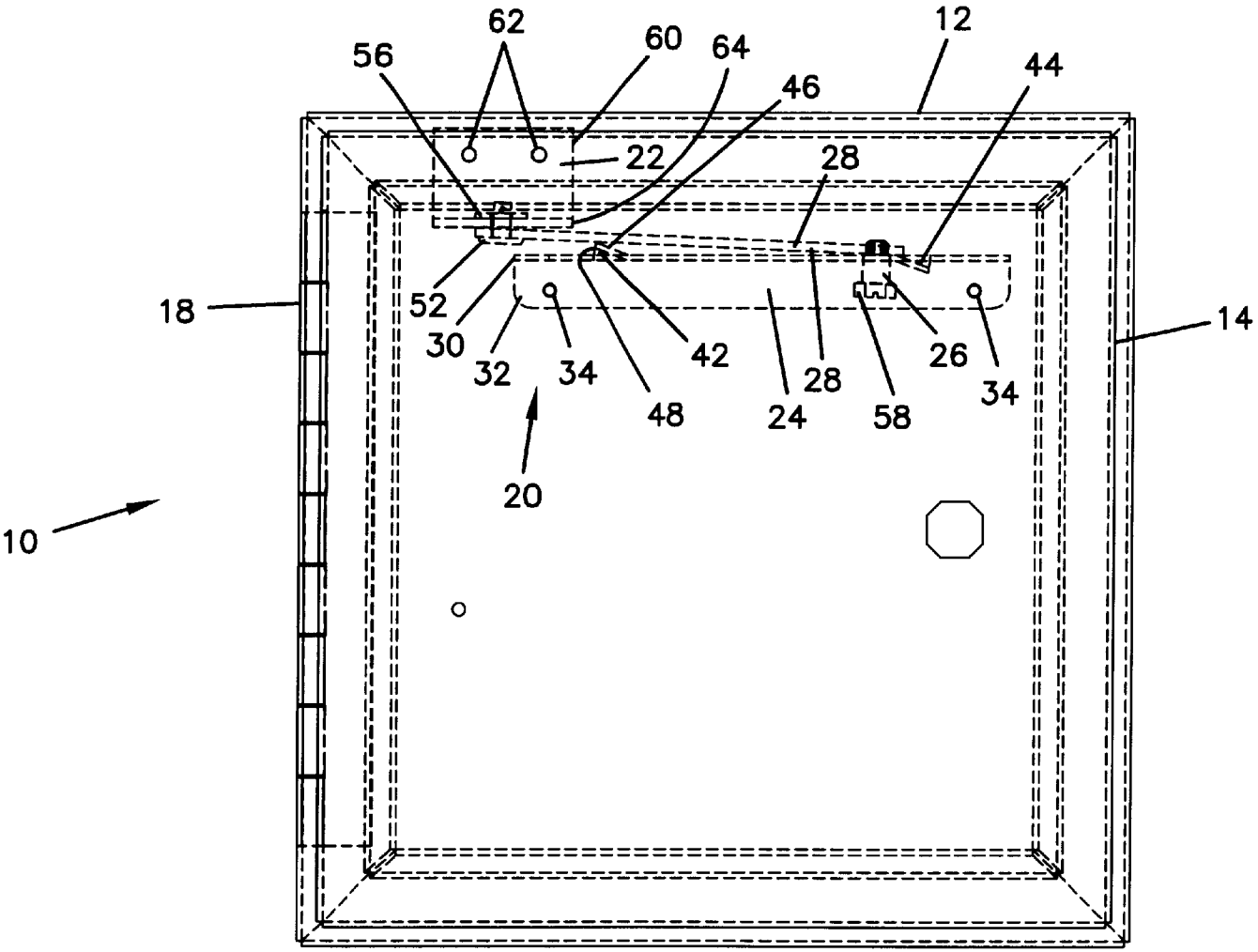
FIG. 3 shows a side elevational view of the door stop apparatus of FIG. 1 mounted near a top of the door in a closed position.
Figure 4:
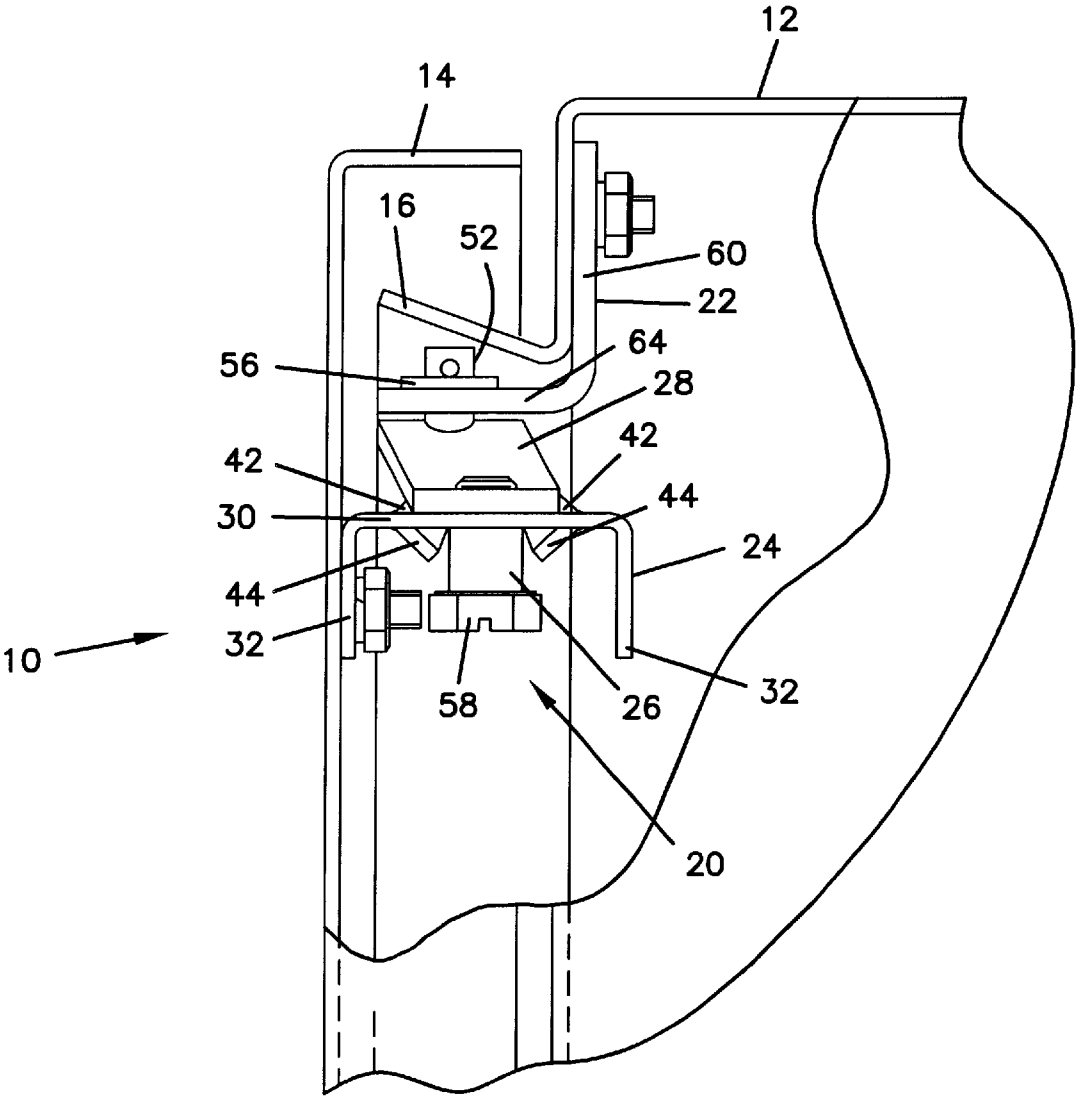
FIG. 4 shows an end elevational view of the door stop apparatus of FIG. 3.

The follower 26 includes a widened head portion 58, as shown in FIG. 3, and may typically be, for example, a slotted hex head bolt. Referring now to FIGS. 3–6, the door stop 20 may be mounted in either orientation for mounting at either the top or bottom of the door 14. In both mounting configurations, the follower member 26 extends through the slot 40. However, when mounted at the lower edge of the door 14, the widened head 58 extends above the slot 40 and rests on the horizontal portion 30 of the guide member 24. When mounted near the top of the door 14, the link 28 extends above the upper surface of the guide member 24.

The mounting bracket 22 includes a vertical portion 60 with mounting holes 62 for mounting to the frame 16 in either orientation. The mounting bracket 22 has a horizontal portion 64 for receiving the mounting pin 52 for pivotally attaching the link 28. The mounting pin 52 may include a washer 56 and retaining pin 54 (shown in FIGS. 1 and 2), for holding the pin 52 and for easy assembly.

Figure 6:
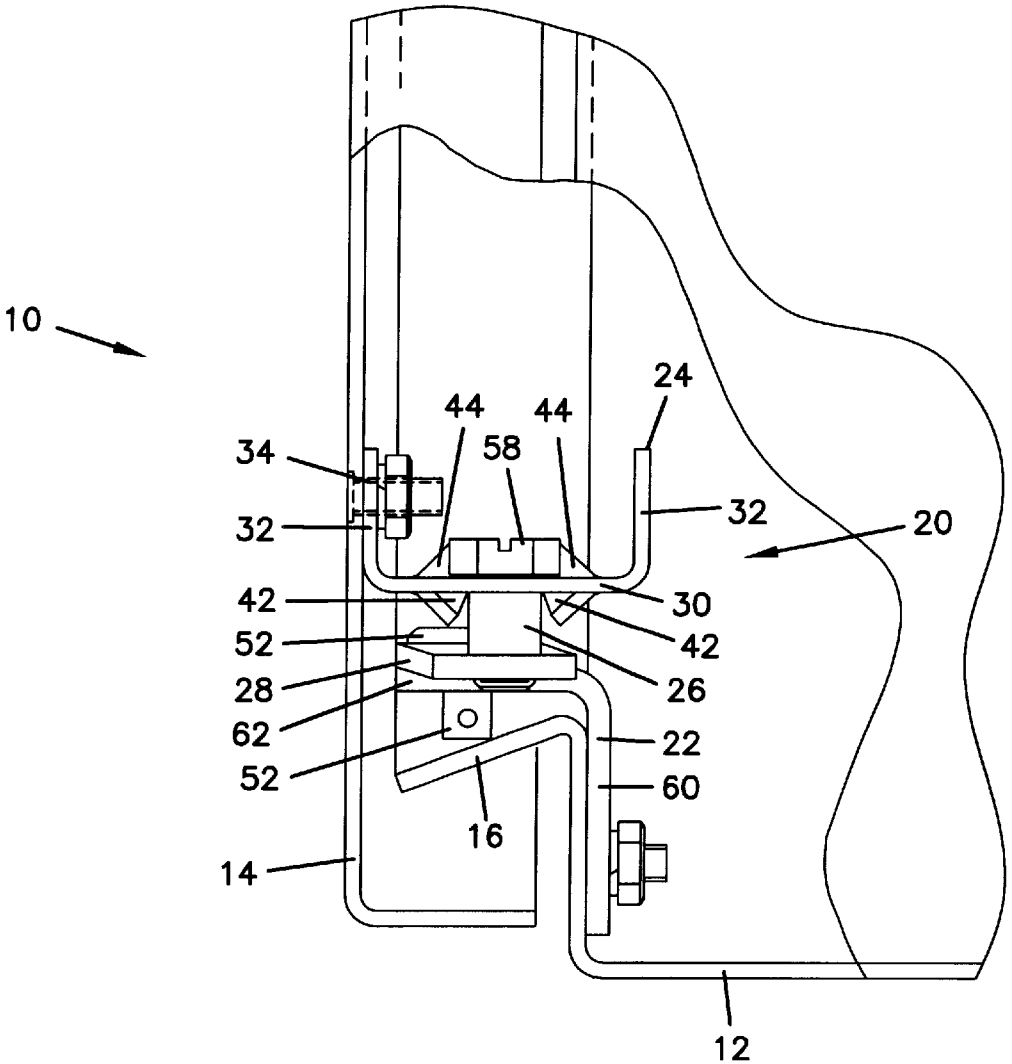
FIG. 6 shows an end elevational view of the door stop apparatus mounted as in FIG. 5.
Figure 7:
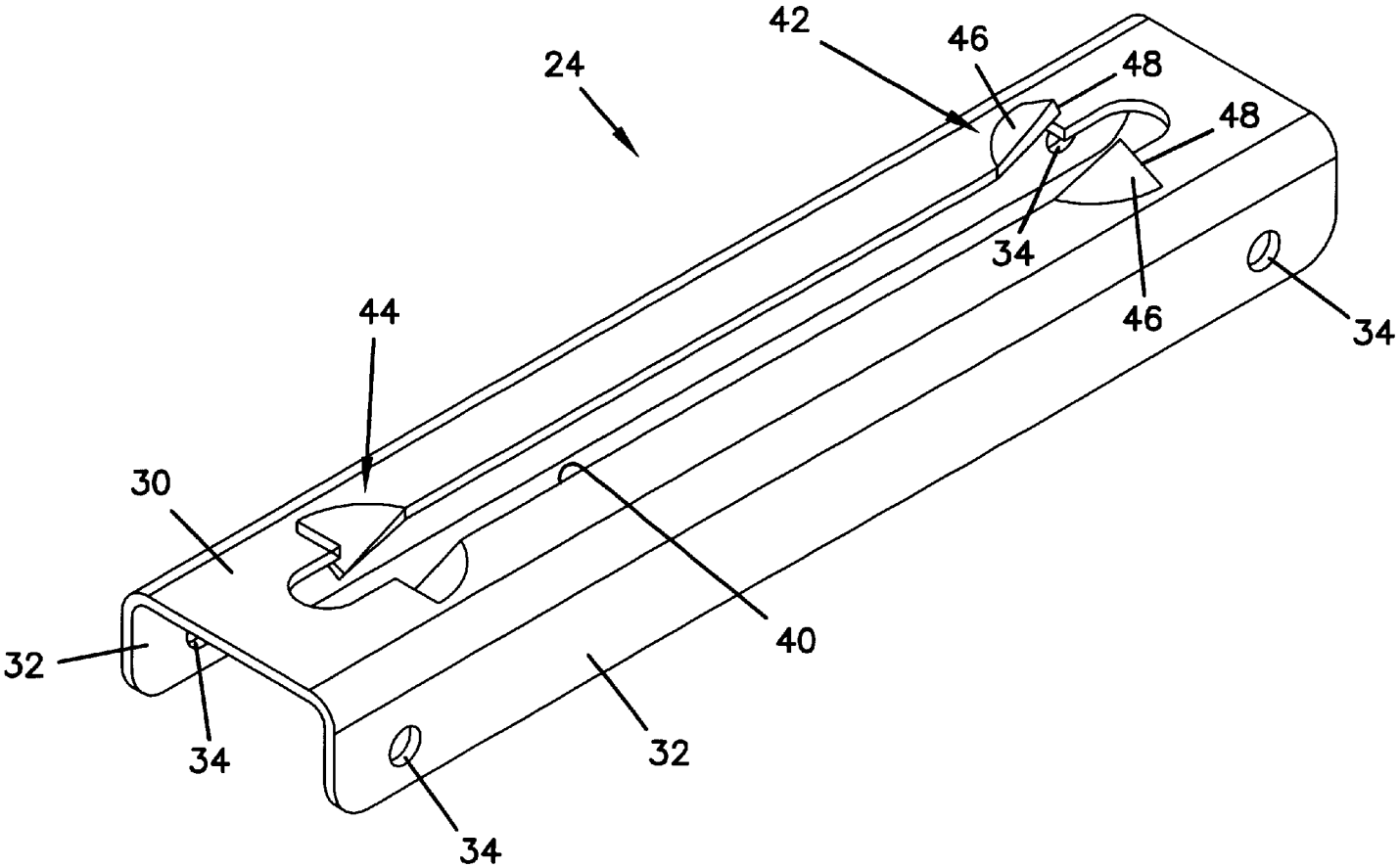
FIG. 7 shows a perspective view of a guide member for the door stop apparatus of FIG. 1.

Referring now to FIG. 7, the guide member 24 is shown as a channel type member having a horizontal portion 30 and side mounting portions 32. The side mounting portions 32 include orifices 34 for attaching to either side. In this configuration, the same element may be used for mounting to either a left or right oriented opening door and also for mounting in either the orientation shown or in an inverted position, such as those mounting positions shown in FIGS. 3–6. Referring now to FIG. 7, the horizontal portion 30 includes a longitudinal slot 40 formed therein extending along a substantial portion of the guide member 24. In a first embodiment, at a first end of the slot 40 is formed a gate 42 while on the opposite end of the slot 40 is a second gate 44 extending in an opposite orientation to provide reversibility, as explained hereinafter. Each of the gates 42 and 44 includes an upper ramping surface 46 and an edge 48. The upper surfaces 46 form a ramp extending gradually upward from the horizontal surface 30. The edges 48 form a sharp intersection with the horizontal portion 30 and provide for engaging and stopping the follower 26 and link 28 to hold the door 14 in an open position, as explained hereinafter. It can be appreciated that the gate 42 is shown forming a ramp extending upward as in FIG. 7, with the gate 44 projecting downward. However when inverted, the gate 44 extends upward from the horizontal portion 30 and the gate 42 extends downward. In either position, a gate extends upward with a ramp surface 46 and a stop surface 48 rising from the horizontal portion 30. The guide member 24 may be mounted so that either end of the slot is positioned on the near or far portion of the door 14. The gates 42 and 44 are easily formed by flaring portions of the horizontal portion 30 out of the horizontal plane.

Figure 8:
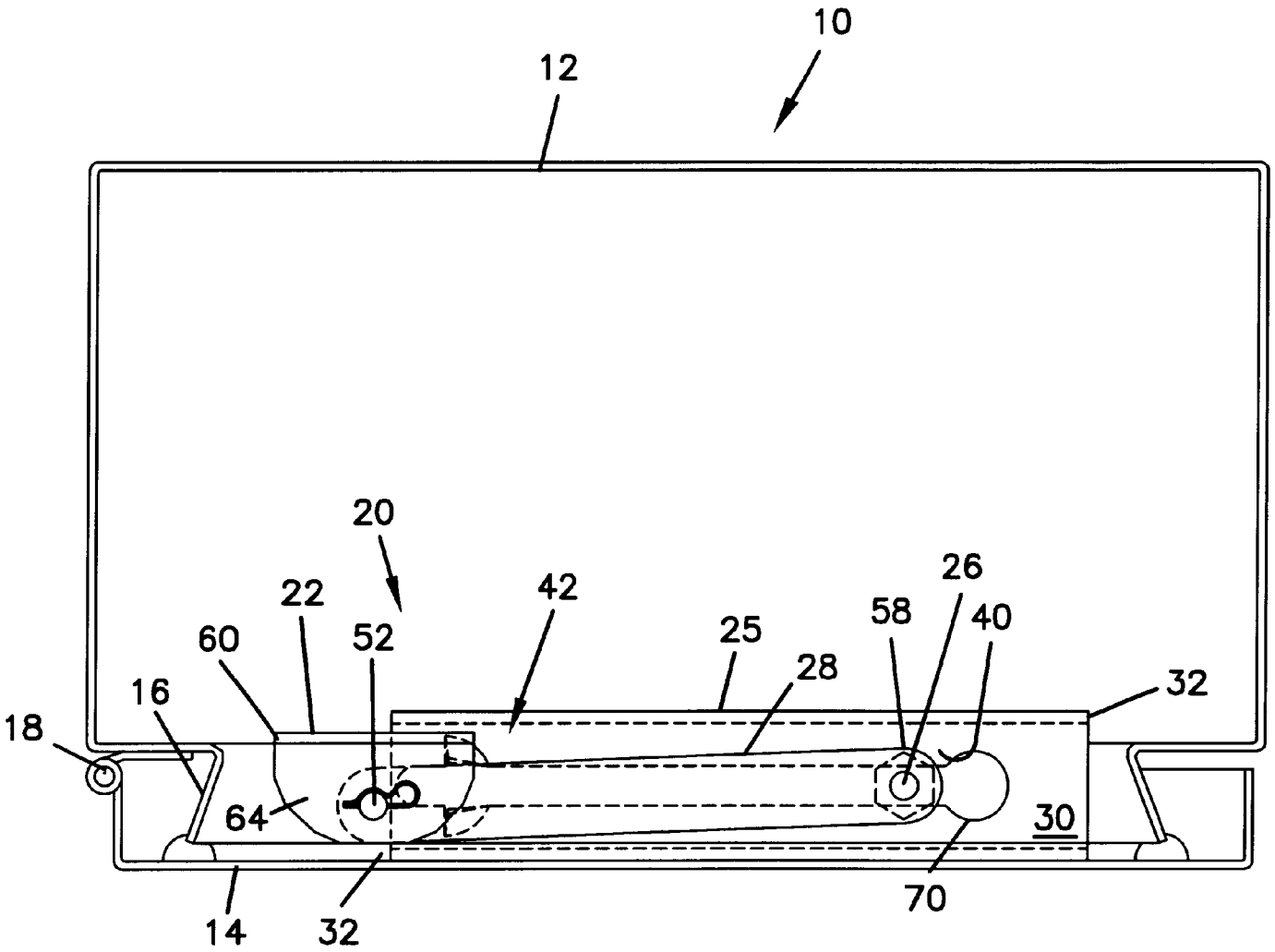
FIG. 8 shows a top plan view of a door stop apparatus according to the principles of the present invention with a second embodiment of a guide member.

Referring now to FIG. 8, a second embodiment is shown with a guide member 25. The guide member 25 is similar to the guide member 24. However, the guide member 25 includes a widened opening 70 formed at one end of the slot 40, rather than a second gate. The guide member 25 can also be reversibly mounted for opening to the left or right. The widened opening 70 provides for pulling the follower 26 out of the slot 40 for easy assembly and disassembly. The stop 20 is positioned on the housing 12 and door 14 so that the follower 26 does not reach the opening 70 during normal travel.

Figure 5:
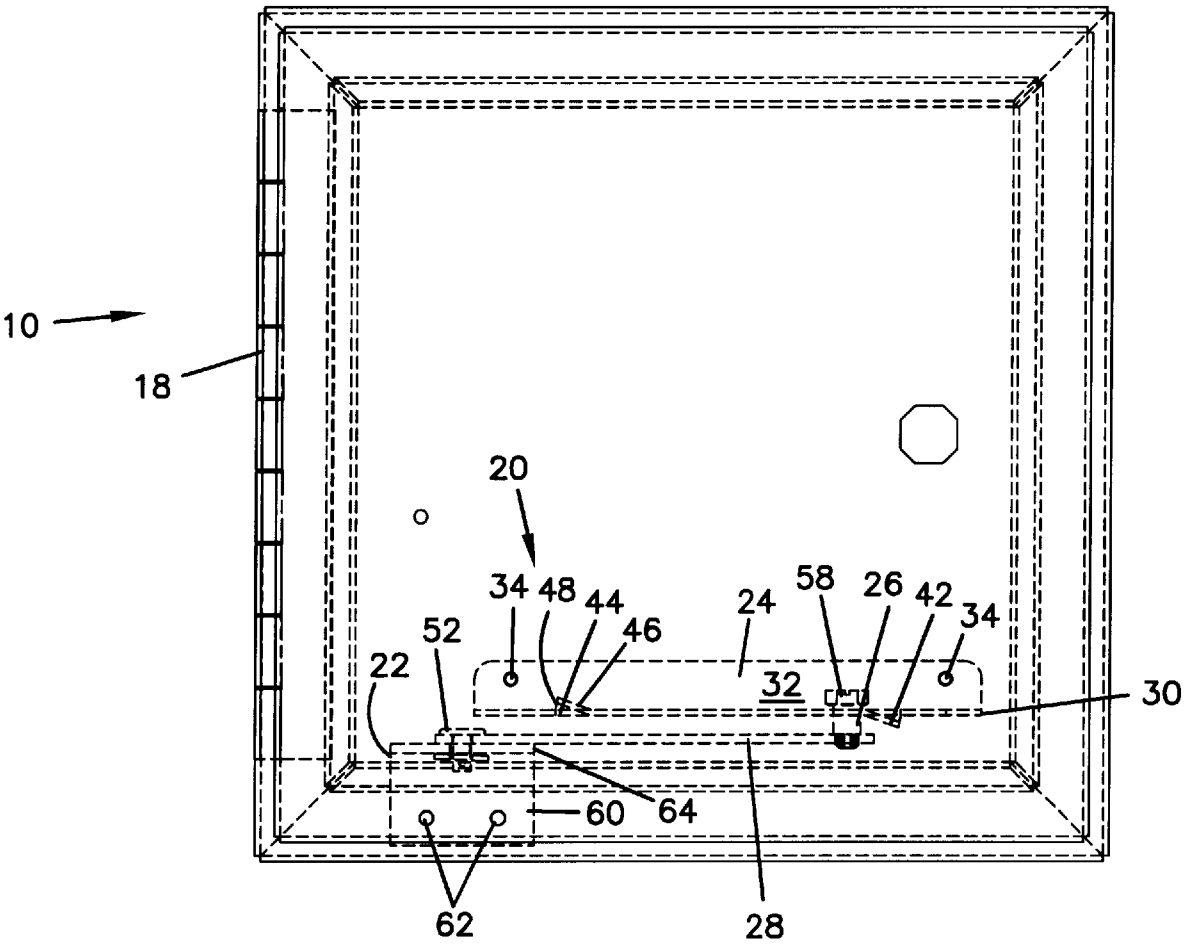
FIG. 5 shows a side elevational view of the door stop apparatus of FIG. 1 mounted near a bottom of the door in a closed position.

To assemble the stop 20, the bracket 22 is mounted to the housing 12 in either the upper or lower configuration shown in FIGS. 3 or 5. The guide member 24 is mounted to the interior of the door in position so that the door 14 is held open the desired distance when the stop 20 engages. If the stop 20 is mounted near the upper edge of the door 14, the guide member 24 is mounted with the horizontal portion 30 at the top. If the stop 20 is near the lower edge of the door, the guide member 24 is mounted with the mounting portions 32 extending up from the horizontal portion 30. The follower 26 is inserted into the slot 40 and attached to the link 28. The connecting pin 52 is inserted in an opposite end of the link 28 through an orifice in a horizontal portion 64 of the mounting bracket 22. The upward extending gate 42 or 44 is near the bracket 22 while the downward extending gate is extended away from the bracket 22. However, the follower 26 will be nearer the downward extending gate 42 or 44 when the door 14 is closed. The stop 20 is positioned so that the widened head 58 or the width of the link 28 do not reach the downward extending gate 42 or 44, as the follower 26 does not travel all the way to the end of the slot 40 in the closed position.

To engage the stop 20, the door 14 is simply rotated open. The link 28 pivots with the door 14 while the follower 26 slides along the slot 40 until the follower 26 engages the upper surface 46 of the gate 42 or 44. For the configuration shown in FIGS. 3 and 4, the bottom surface of the link 28 slides over the upper surface 46 of the gate 42. As shown in FIGS. 5 and 6, the lower surface of the widened head 58 of the follower 26 rides over the upper surface 46 of the gate 44. As the slot 40 does not widen, the link 28 and follower 26 slide easily over the gates 42 and 44. When the link 28 and follower 26 clear the gate 42 or 44, gravity causes the link 28 and follower 26 to fall back into engagement with the horizontal portion 30 of the guide member 24. In this position, the door 14 is open and the follower 26 is at the end of the slot 40, as shown in FIG. 1. Should wind or other forces tend to cause the door 14 to close, the follower 26 or the link 28 will abut the edge 48 on the gate 42 or 44 and cannot slide over the surface of the gate 42 or 44. This engagement maintains the door 14 in an open position and prevents closure with a positive mechanical stop. No special alignment is required as the follower 26 never disengages the slot 40.

To disengage the stop 20, the follower 26 is simply lifted upward and slid to clear the edge 48. The door 14 is closed slightly, so that the follower 26 is slid back to a position further along the slot 40 to pass beyond the edge 48. At this position, the link 28 and follower 26 may be dropped back down and engage either the upper ramp surfaces 46 or the horizontal portion 30 of the guide member 24, where sliding may occur longitudinally along the slot 40 without further impairment.

The guide member 24, mounting bracket 22, link 28 and follower 26 are all configured for vertical and horizontal reversibility so that the same elements may be used for mounting in either a normal or inverted orientation. In addition, the guide member 24 includes orifices 34 on either side for mounting to either left or right opening doors. The link 28 and follower 26 may be changed to slide in either direction along the slot 40 with orientation of the mounting bracket 22 in the horizontal plane being changed by simply moving the bracket to a different mounting location. The stop 20 is completely reversible, even when assembled. The guide member 24 may be rotated for left or right opening doors. The follower 26 and link 28 are positioned in the same manner relative to the guide member 24 whether at the upper or lower mounting position. Only the surfaces engaging, rather than the assembly, changes. Moreover, the range of motion for the door 14 may be adjusted by varying the mounting position of the guide member 24 along the door 14. In addition, with some applications, the guide member 24 is mounted to the enclosure 12 and the mounting bracket 22 is attached to the door 14 without affecting the operation of the door 14 or stop 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A door stop apparatus for holding a door open relative to a frame, the apparatus comprising;

a horizontally extending planar member mounted to the door, and having a top face, a bottom face, and a slot formed longitudinally therethrough from the top face to the bottom face, the slot having a first one way ramp portion projecting outward from the top face located near one end of the slot and a second one way ramp portion projecting outward from the bottom face;

a link member, pivotally mounted to the frame:

a follower mounted to the link member and longitudinally and vertically slidably mounted in the slot;

wherein each of the one way ramp portions has a first end and a second end, each ramp portion including a first surface extending from its first end at a first angle to the planar member, the first surface defining an edge at the second end forming a second angle with the planar member, wherein the second angle is steeper than the first angle, such that the follower is stopped from sliding further upon abutting the edge.

2. A door stop apparatus according to claim 1, wherein the door stop apparatus reversibly mounts to the door.

3. A door stop apparatus according to claim 1, wherein the ramp comprises a portion of the first member raised upward.

4. A door stop apparatus according to claim 1, wherein the first and second ramps are proximate opposed ends of the slot.

5. A door stop apparatus according to claim 1, wherein the follower includes a widened portion adapted to slide over the ramp in a first direction and to abut the ramp in a second direction.

6. A door stop apparatus according to claim 1, wherein the slot in the first member includes a widened portion proximate a second end of slot.

7. A door stop for holding a first member relative to a second member, the door stop comprising;

a horizontal guide element mounted to the first member, the guide element having a top face, a bottom face, and having a longitudinal slot formed therethrough from the top face to the bottom face, the slot having first and second one way gate devices projecting from the top and bottom faces of the guide element, providing for mounting the door stop in a first position and a second inverted position; and a slider member, pivotally mounted to the second member, the slider having a follower, wherein the follower slides along the slot and passes beyond one of the one way gate devices in a first direction upon opening the door and is retained by one of the one way gate devices in a second directions;

wherein each of the one way gates devices has a first end and a second end, each one way gate device including a first surface extending from its first end at a first angle to the guide element, the first surface defining an edge at the second end forming a second angle with the guide element, wherein the second angle is steeper than the first angle, such that the slider member is stopped from sliding further upon abutting the edge.

8. A door stop according to claim 7, wherein the one way gate retains the follower proximate a nearest end of the slot.

9. A door stop according to claim 7, wherein the follower comprises a pin with a widened head slidably vertically mounted to the slider.

10. A door stop according to claim 7, wherein the slot in the guide element includes a widened portion proximate a second end of the slot.

11. A door stop apparatus for holding a door open relative to a frame, the apparatus comprising;

a first member mounted to the door, and having a slot formed therein, the first member having two ramps along the slot, a first ramp on a first face and a second ramp on a second face for reversible and invertible mounting, wherein each of the ramps includes an upper portion having an edge, wherein the ramp meets the first member at a first angle and the edge meets the first member at a second angle, steeper than the first angle;

a link member, pivotally mounted to the frame, a follower vertically slidably mounted to the link member and slidably mounted in the slot;

wherein the follower automatically slides up and over the upper portion of the ramp upon sliding in a first direction and stops upon abutting the edge of the ramp upon sliding in a second opposite direction.

12. A door stop apparatus according to claim 11, wherein the follower is adapted for being manually lifted up and over the ramp upon sliding in a second direction.

13. A door stop apparatus according to claim 12, wherein the follower comprises a pin having a widened head portion.

14. A door stop apparatus according to claim 11, wherein the follower comprises a pin, and wherein the pin is free floating and includes a widened portion, wherein the pin automatically passes over the ramp portion upon opening the door and wherein the pin engages the edge when closing the door.

15. A door stop apparatus according to claim 11, wherein gravity biases the follower into engagement with the first member.

* * * * *